US007575022B2

(12) United States Patent
Higgins

(10) Patent No.: US 7,575,022 B2
(45) Date of Patent: Aug. 18, 2009

(54) DIVERTER, LIQUID-LEVEL INDICATOR AND CHEMICAL PRE-TREATMENT AND POST-TREATMENT IMPLEMENTATIONS USEFUL IN WATERLESS URINALS

(75) Inventor: Michael Higgins, La Habra Heights, CA (US)

(73) Assignee: Falcon Waterfree Technologie, Los Angeles, CA (US)

( * ) Notice: Subject to any disclaimer, the term of this patent is extended or adjusted under 35 U.S.C. 154(b) by 443 days.

(21) Appl. No.: 11/032,508

(22) Filed: Jan. 9, 2005

(65) Prior Publication Data

US 2005/0247342 A1 Nov. 10, 2005

Related U.S. Application Data

(63) Continuation-in-part of application No. 10/647,603, filed on Aug. 25, 2003, now Pat. No. 6,973,939.

(60) Provisional application No. 60/535,463, filed on Jan. 9, 2004, provisional application No. 60/579,921, filed on Jun. 14, 2004.

(51) Int. Cl.

| | |
|---|---|
| ***F16K 37/00*** | (2006.01) |
| ***E03C 1/28*** | (2006.01) |
| ***E03C 1/29*** | (2006.01) |
| ***A47K 11/12*** | (2006.01) |

(52) U.S. Cl. ..... 137/558; 137/247.11; 137/247.29; 4/144.1; 4/301; 4/309; 4/679

(58) Field of Classification Search ..... 137/247.11, 137/247.27, 247.29, 247.33, 247.35, 247.41, 137/558; 4/144.1, 301, 309, 310, 311, 669, 4/679

See application file for complete search history.

(56) References Cited

U.S. PATENT DOCUMENTS

| | | | | |
|---|---|---|---|---|
| 2,582,031 | A * | 1/1952 | Harbison | 137/247.33 |
| 3,824,633 | A * | 7/1974 | Van Vlahakis | 4/222 |
| 4,103,367 | A * | 8/1978 | Kaufer | 4/222 |
| 5,711,037 | A * | 1/1998 | Reichardt et al. | 4/301 |
| 6,053,197 | A * | 4/2000 | Gorges | 137/247.39 |
| 6,286,153 | B1 * | 9/2001 | Keller | 4/301 |
| 6,418,569 | B1 * | 7/2002 | Knight | 4/679 |
| 2004/0181861 | A1 * | 9/2004 | Inglin et al. | 4/144.1 |
| 2004/0211267 | A1 * | 10/2004 | Higgins | 73/861.86 |

(Continued)

FOREIGN PATENT DOCUMENTS

| | | |
|---|---|---|
| DE | 101 48 959 A1 | 4/2003 |

(Continued)

*Primary Examiner*—John Rivell
(74) *Attorney, Agent, or Firm*—Lewis B. Sternfels

(57) ABSTRACT

A diverter (170, 270) atop the upper wall (110) of a cartridge (100) and over the opening (114, 115) therein avoids direct access of urine to the opening and the sealant (105) within the cartridge. The diverter is spaced by standoffs (182, 282) from the upper wall to provide a urine flow passage. A float (274) can be incorporated in the diverter to provide a visible signal of the presence of collected urine on the cartridge upper wall. A pre-treatment chemically-constituted tablet (210) held by a retainer (200) in the diverter provides sanitizing and/or deodorizing means. Post-treatment chemically-constituted tablets (224*a*) or pellets (224*b*) placeable at the outlet of the cartridge protect the drain pipe from corrosion and other harm.

22 Claims, 19 Drawing Sheets

U.S. PATENT DOCUMENTS

2005/0229297 A1 * 10/2005 Higgins ..... 4/301
2005/0229971 A1 * 10/2005 Higgins ..... 137/247.13

FOREIGN PATENT DOCUMENTS

EP 365789 A1 * 5/1990 ..... 4/679
GB 2 319 540 A 5/1998
GB 2 355 185 A 4/2001
WO WO 9425693 A1 * 11/1994 ..... 4/144.1

* cited by examiner

DIVERTER, LIQUID-LEVEL INDICATOR AND CHEMICAL PRE-TREATMENT AND POST-TREATMENT IMPLEMENTATIONS USEFUL IN WATERLESS URINALS

CROSS-REFERENCE TO RELATED APPLICATION

This application claims the benefit, and is a continuation-in-part of both U.S. Provisional Application No. 60/535,463 filed 9 Jan. 2004 and U.S. Provisional Application No. 60/579,921 filed 14 Jun. 2004, and is a continuation-in-part of the following provisional and nonprovisional applications: Ser. No. 10/647,603, filed 25 Aug. 2003; now U.S. Pat. No. 6,973,939 Ser. No. 10/744,708, filed 23 Dec. 2003; Application No. 60/535,463, filed 9 Jan. 2004; and any of their predecessor applications.

REFERENCE REGARDING FEDERAL SPONSORSHIP

Not Applicable

REFERENCE TO MICROFICHE APPENDIX

Not Applicable

1. Field of the Invention

The present invention relates to a diverter, a liquid level indicator and a liquid conditioner and, more particularly, to improved devices and methods therefor for use in a urinal, such as in a water-free urinal.

2. Description of Related Art and Other Considerations

In water-free urinals, such as described in U.S. Pat. Nos. 6,053,197 and 6,425,511 [Ser. No. 09/855,735 (filed 14 May 2001)] and U.S. patent application, Ser. No. 10/143,103 (filed 7 May 2002), it has been observed that urine can be directed with some intensity through the opening of the cartridge and impinge with sufficient force on the sealant therein to adversely affect its sealing function and also that, because dried urine can form blockages within the cartridge, liquid urine can collect on its upper surface and possibly impede flow therefrom to create a sanitary problem. Further, in the mechanism described in above-mentioned U.S. Pat. No. 6,750,773, such collected urine may corrode or otherwise disrupt the mechanical and electrical operations of the liquid flow meter described therein.

SUMMARY OF THE INVENTION

These and other problems are successfully addressed and overcome by the present invention, along with attendant advantages, by placing a diverter atop the upper wall of the cartridge and over the opening therein for avoiding direct access of urine to the opening. The diverter is spaced from the upper wall to provide a urine flow passage. An indicator, such as a float, can be incorporated in the diverter to provide a visible signal of the presence of collected urine on the cartridge upper wall. Further, a pre-treatment chemically-constituted tablet or other substance may be incorporated in the diverter to provide sanitizing and/or deodorizing means. Additionally, one or more post-treatment chemically-constituted tablet or pellets may be placed at the outlet of the cartridge to protect the drain pipe from corrosion and other harm.

Several advantages are obtained derived from these arrangements. The life of the cartridge is increased. Fewer replacements of cartridges are possible. The need to service cartridges is minimized. Profitability is increased.

Other aims and advantages, as well as a more complete understanding of the present invention, will appear from the following explanation of exemplary embodiments and the accompanying drawings thereof.

DETAILED DESCRIPTION

Figure 1:
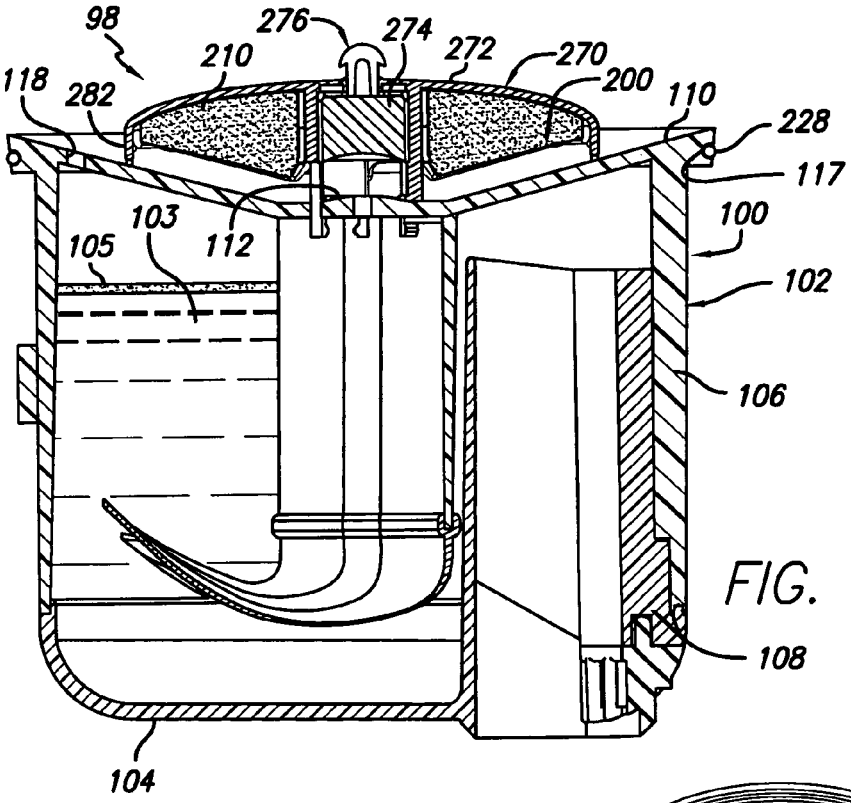
FIG. 1 is a view, in cross-section, of a cartridge for use in a urinal with a first embodiment of a urinal diverter positioned thereon and secured to its top.
Figure 2:
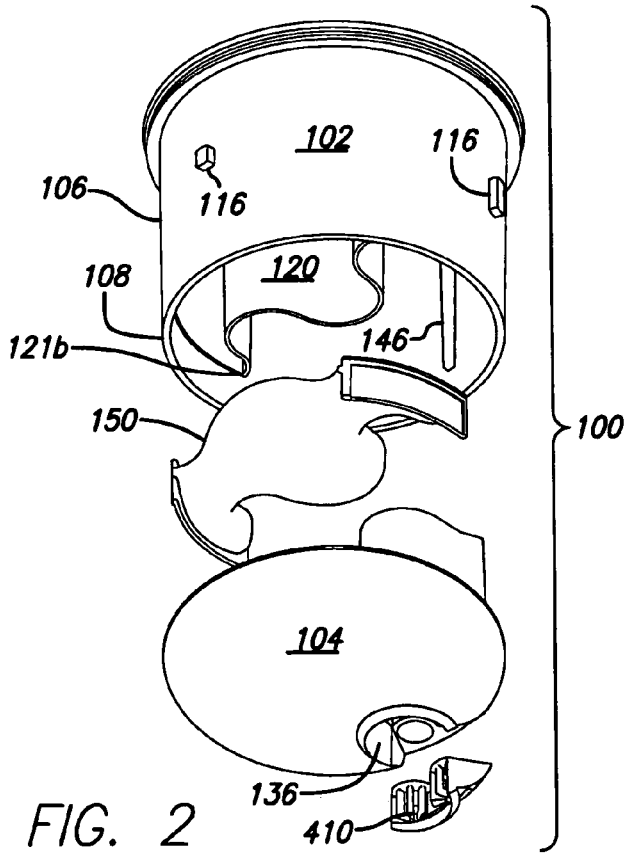
FIG. 2 is an exploded view, in perspective, of the cartridge, per se, illustrated in FIG. 1.
Figure 3:
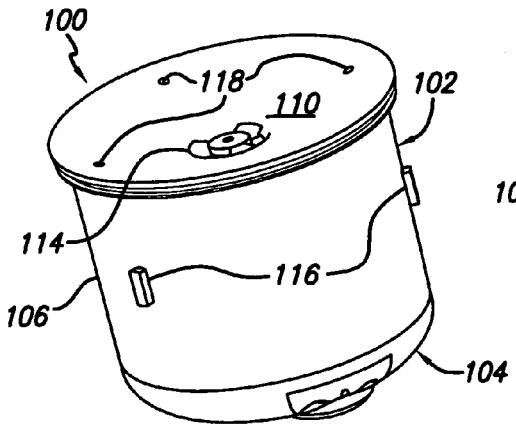
FIGS. 3 and 4 are perspective views taken respectively from the top and bottom of the cartridge, per se, shown in FIG. 1.
Figure 4:
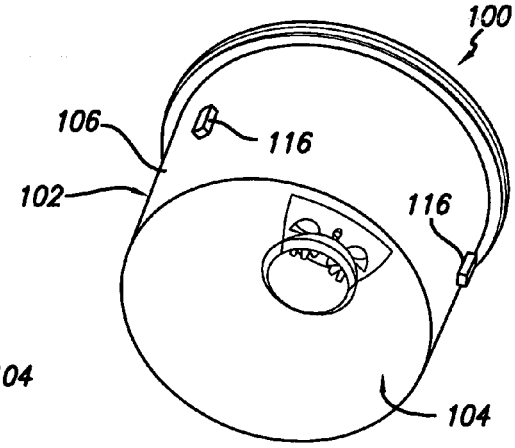
Figure 5:
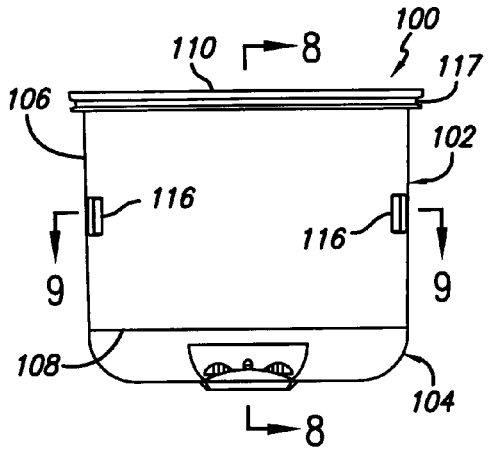
FIGS. 5-7 respectively are side, top and bottom views of the cartridge, per se, shown in FIG. 1.

Accordingly, as depicted in FIGS. 1-19, a urinal insert 98 comprises a cartridge or cartridge assembly 100, which is sometimes referred to as an "oil sealant-preserving drain odor trap." Cartridge assembly 100, acting as a flow trap for urine or other generally fluid waste products, comprises a top portion 102 and a bottom portion 104. Wastewater 103, such as a fluid with urine therein, and an oily liquid odor sealant 105 floating on the wastewater is contained within the cartridge. Alternate embodiments of a diverter, such as a diverter 270 (FIGS. 34-46 and a diverter 170 (FIGS. 20-27B), can be secured to top portion 102.

Figure 6:
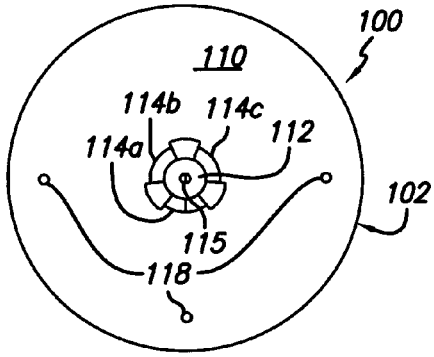
Figure 7:
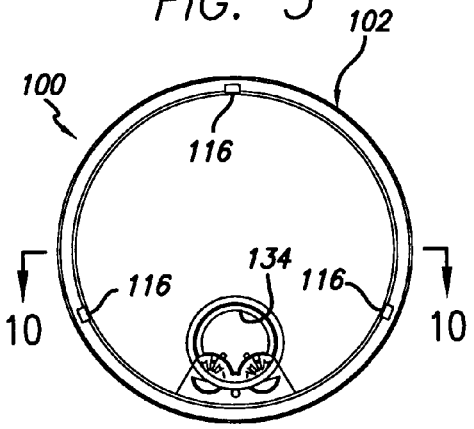

Top portion 102 has a cylindrical configuration defined by a tubular wall 106 terminated by an opening 108 at its lower end and a top wall 110 at its upper end. The top wall is sloped downwardly from its outer edge to a flat, generally horizontal flat center portion 112 in which an entry opening 114 is disposed (see FIGS. 3, 6 and 8), to act as a urine inlet. As depicted in FIG. 6, opening 114 comprises a tripartite arrangement of three arced slots 114*a*, 114*b* and 114*c*. A hole 115 is centrally positioned within center portion 112. As will be described with respect to FIGS. 20-46, slots 114*a*, 114*b* and 114*c* and hole 115 are adapted to hold the respective ones of the two diverters (170 and 270) to cartridge 100. Top portion 102 is further provided with three keys 116 of which one may be of different length than the other two (e.g., see FIG. 2) for purposes of properly placing and orienting cartridge 100 within a urinal, as more fully described in U.S. Pat. No. 6,644,339 (the parent application of above-noted Ser. No. 10/647,603).

Top wall 110 is provided with a recess 117, for example as shown in FIGS. 1, 5 and 52-54 at its outer periphery to accept a seal, such as O-ring seal 228. Recess 117 has a small dimension sufficient to minimize the trapping of urine therein.

Top wall 110 of top portion 102 is further provided with three openings 118 (e.g., FIGS. 1, 3, 6, 8 and 10) which act as air vents that communicate with the interior of cartridge 100. In the event that one or two may become clogged, such as by urine when the urinal is in use, there will be at least one that remains open. Openings 118 also provide a means by which a tool may be inserted therein for the purpose of inserting and removing the cartridge into and from a urinal, as also described in above-noted co-pending provisional application No. 60/535,463, now patent application Ser. No. 11/032,307. Accordingly, for purposes of their use as tool engagement means, it is preferred that the outermost two openings be approximately diagonally opposed to one another. However, the placement or use of these openings may be otherwise designed to accommodate other tool configurations.

Figure 9:
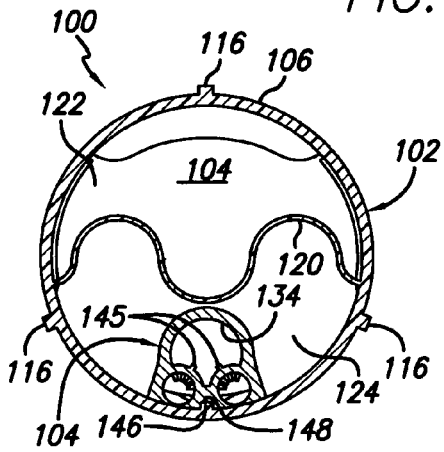
FIG. 9 is a cross-sectional view of the cartridge, per se, shown in FIG. 5 taken along line 9-9 thereof.
Figure 10:
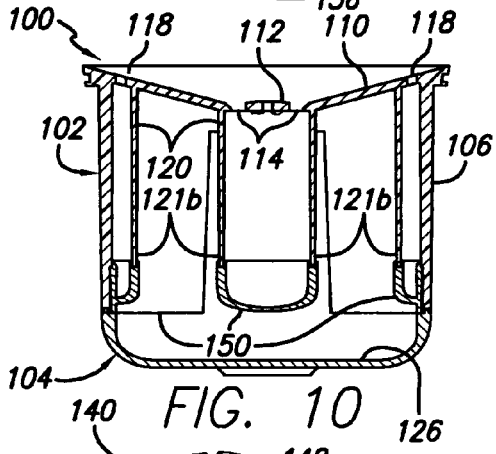
FIG. 10 is cross-sectional view of the cartridge, per se, shown in FIG. 7 taken along line 10-10 thereof.
Figure 11:
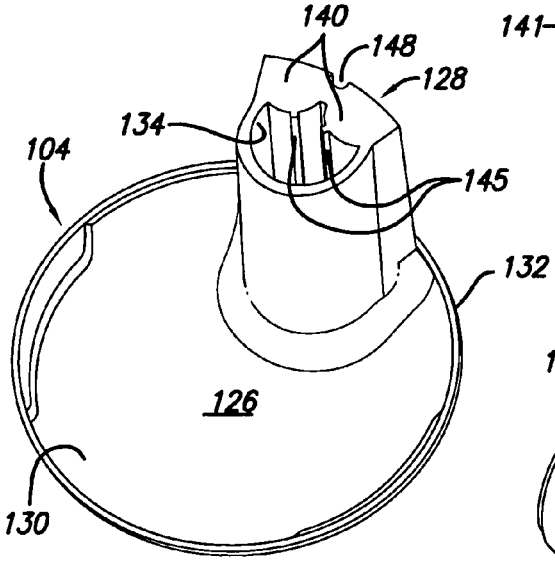
FIGS. 11 and 12 are perspective views of the bottom portion of the cartridge, per se, depicted in FIGS. 1-10, taken respectively from its upper and under sides.

As best shown in FIG. 9, the interior of top portion 102 is divided by a bowed vertical separator 120 into two compartments, respectively an inlet compartment 122 and an outlet compartment 124. Vertical separator 120 is secured or molded to the interior surface of tubular wall 106 and to the underside of top wall 110 in any convenient manner. The bottom end of the vertical separator terminates in an end or terminus 121*b* (e.g., FIGS. 2 and 10) which is disposed to be connected to a baffle 150. When top and bottom portions 102 and 104 are placed together and a discharge section 128 (FIGS. 11-19) of bottom portion 104 extends into outlet compartment 124, inlet compartment 122 and outlet compartment 124 have generally equal volumes. It is important that the compartment volumes be made as equal as possible to ensure that the pressures on both sides of vertical separator 120 remain equal during use of the cartridge. Such equally effected pressure helps to minimize syphoning or, alternatively, to maximize resistance to syphoning between the compartments and, of particular importance, of sucking sealant 105 from the inlet compartment to the outlet compartment. Thus, the usable life of the cartridge is improved by avoiding premature failure thereof. Additionally, any impediment to liquid flow is minimized.

Vertical separator 120 is bowed, e.g., curved or bent, to accommodate centrally positioned entry opening 114 which needs to fully communicate with inlet compartment 122. The illustrated curved bowing of the vertical separator further enables air vent openings 118 also to communicate with the inlet compartment. It is to be understood, however, that the vertical separator need not be curved as illustrated; it may taken any configuration that will effect its purpose, that is, to provide equally volumed compartments and to oblige the communications of openings 114 with the inlet compartment. Therefore, for example, if the air vent openings were not used as a means to cooperate with a cartridge inserting and removing tool, as above described, and/or entry opening 114 were not centrally positioned in top wall 110, or for any other reason apart from its compartment volume-defining purpose, vertical separator 120 may be otherwise configured.

Figure 8:
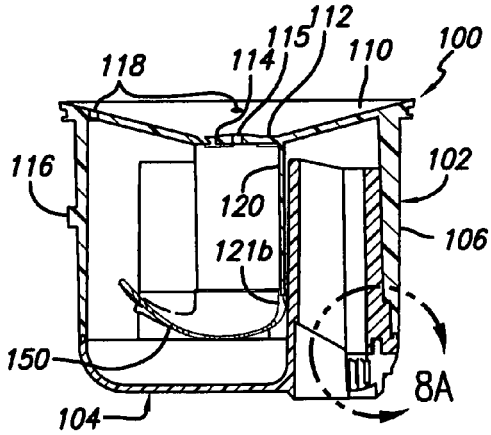
FIG. 8 is a cross-sectional view of the cartridge, per se, shown in FIG. 5 taken along line 8-8 thereof.
Figure 8A:
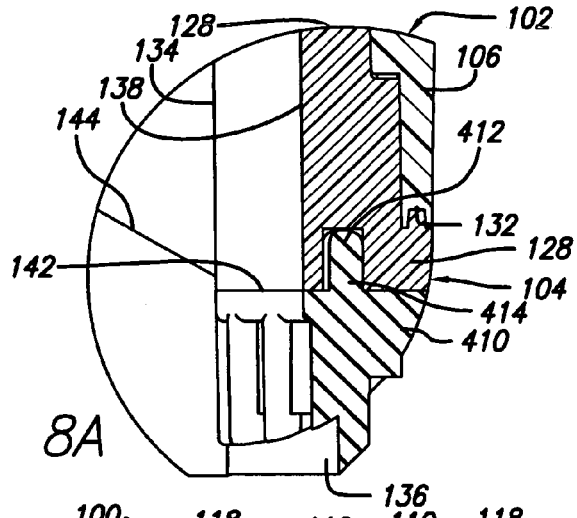
FIG. 8A is a cross-sectional view of a detail of the cartridge taken along cutaway line 8A of FIG. 8.

Bottom portion 104, as depicted in FIGS. 2 and 11-19, comprises a pan 126 and discharge section 128 extending upwardly therefrom. The pan includes a peripheral wall 130 terminating at an edge 132 (FIGS. 11-14, 16, 17 and 19) which provides, as best seen in FIG. 8A, a tongue-in-groove engagement with tubular wall 106 at its lower end opening 108 to provide a fluid-tight engagement between top and bottom portions 102 and 104. The inner surfaces of pan 126 are rounded to prevent sharp angled corners and are smoothed to enhance fluid flow and to discourage build up of matter and bacteria or other debris.

Figure 53:
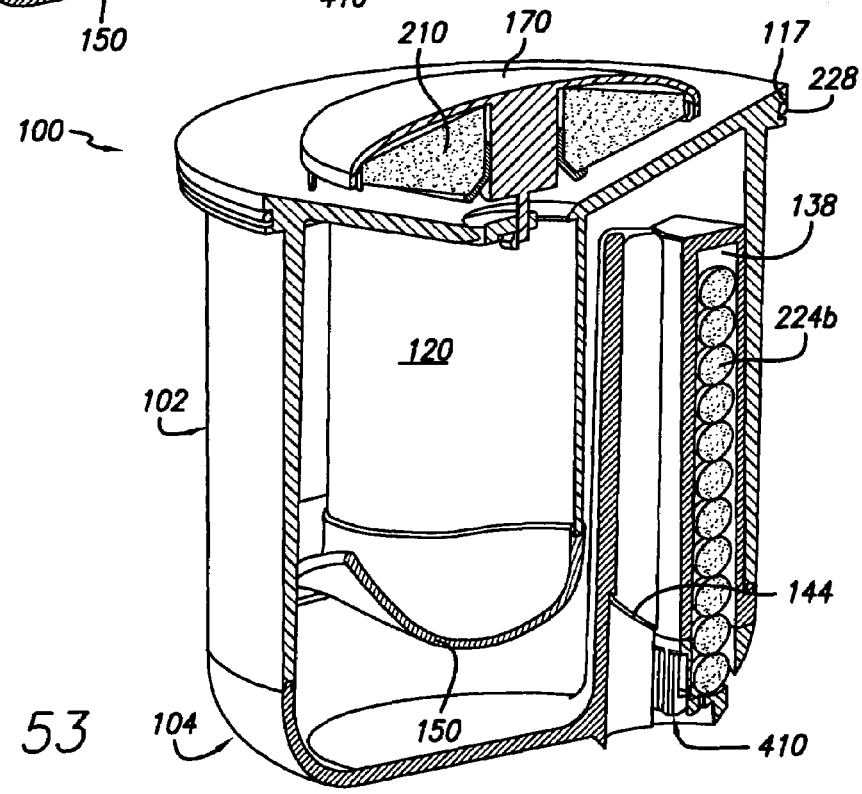
Figure 54:
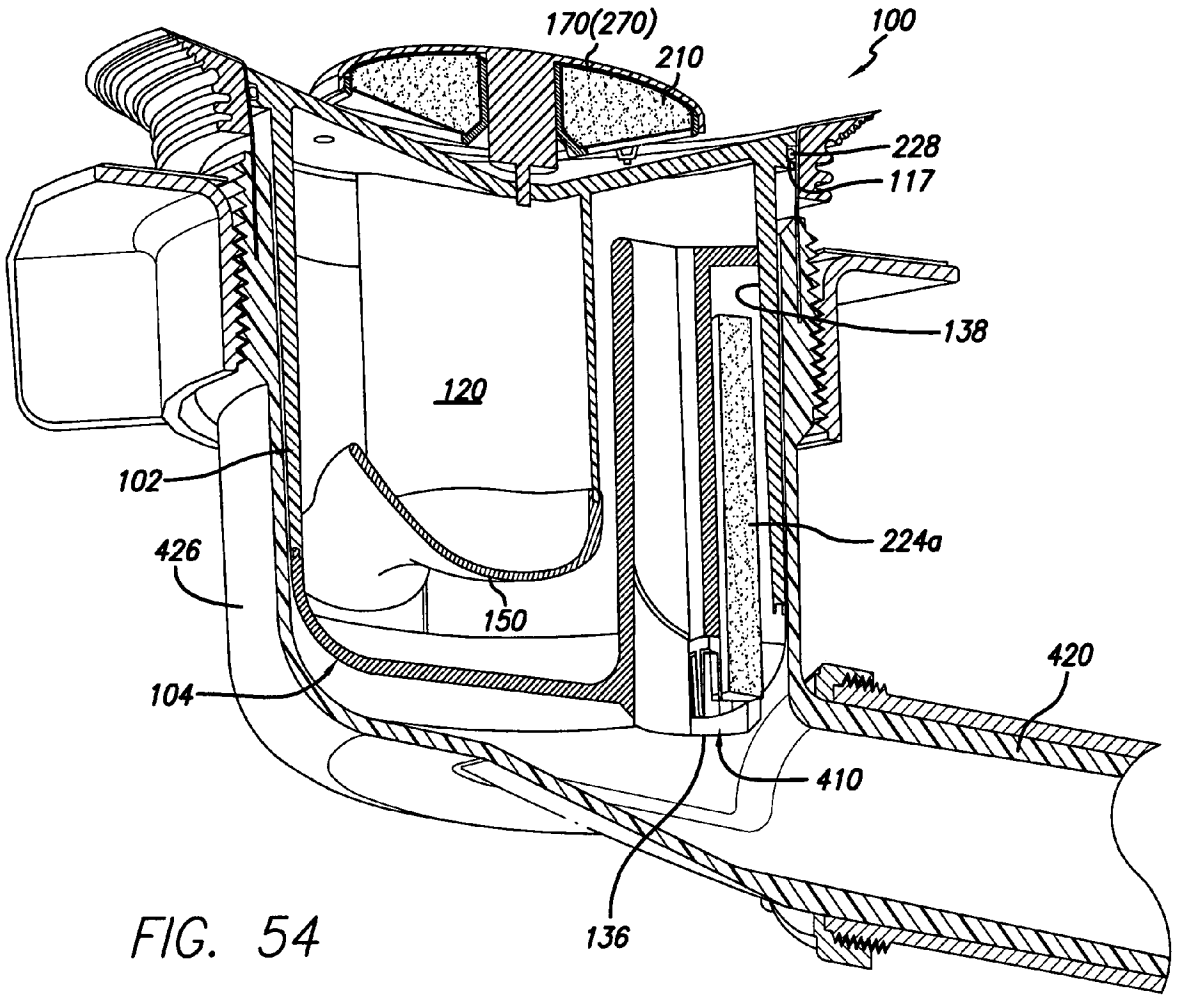
FIG. 54 is a perspective view of a cartridge placed in a part of a water-free urinal as connected to a drain pipe.

Upwardly extending discharge section 128, which as described above extends into outlet compartment 124 of top portion 102, includes (see FIGS. 11-19) a tube 134 that communicates with outlet compartment 104 and opens at an exit port area 136 in pan 126 for discharge of fluids, e.g., wastewater fluid 103 and other undesired matter, from the outlet compartment to a drain 420 (FIG. 54). The discharge section also includes a pair of tubular chambers 138 for receipt of post-treatment chemicals for treating the exiting urine, as contained in control stick 224*a* or pellets 224*b* (FIGS. 53-54), as more fully described in co-pending application, Ser. No. 11/032,310 (provisional application No. 60/579,921). Chambers 138 are closed at a wall 140 (see FIGS. 11 and 18) at one of their ends at the uppermost part of upwardly extending discharge section 128 to prevent flow of fluids thereinto from the outlet compartment, and are open at their other ends 142 (e.g., see FIGS. 12, 16 and 18).

Figure 12:
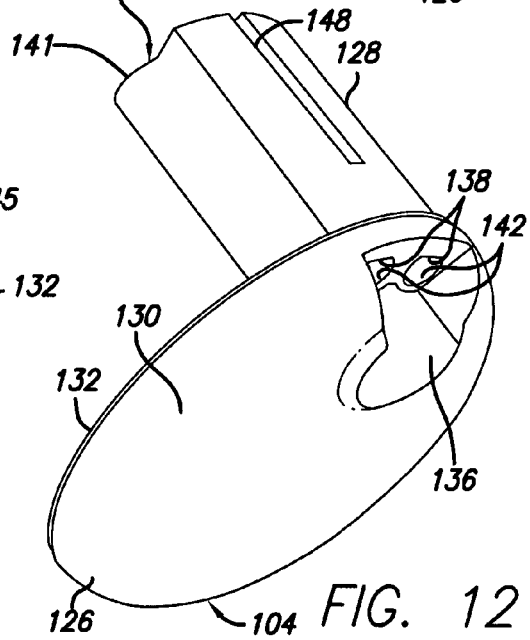
Figure 13:
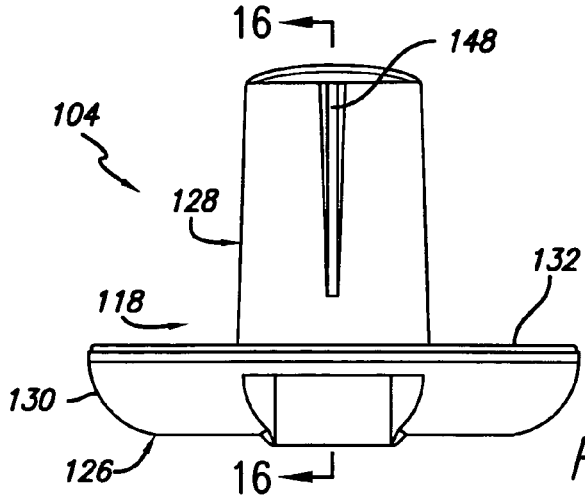
FIGS. 13-15 respectively are side, top and bottom views of the cartridge bottom portion shown in FIGS. 11 and 12.
Figure 14:
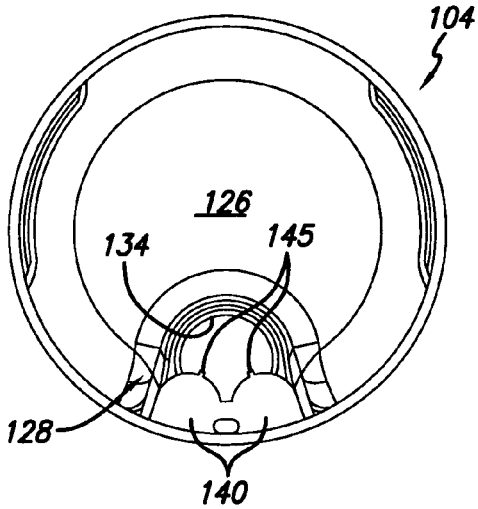
Figure 15:
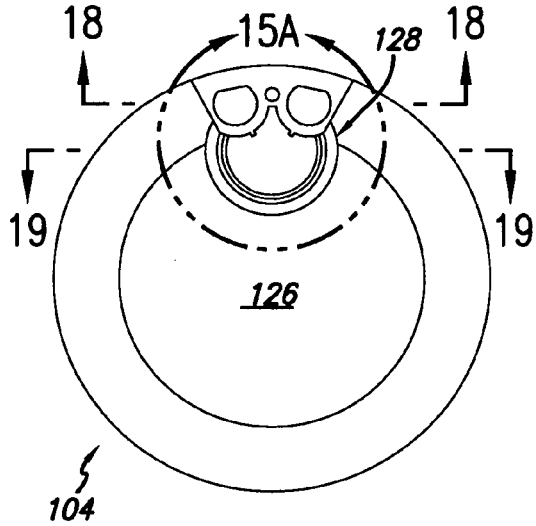
Figure 15A:
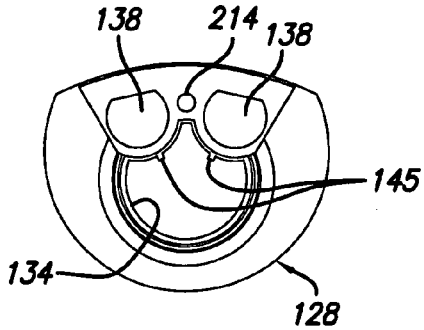
FIG. 15A is a cross-sectional view of a detail of the cartridge bottom portion taken along cutaway line 15A of FIG. 15.
Figure 16:
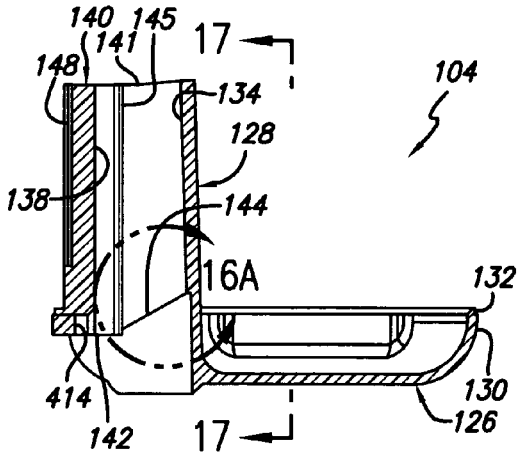
FIG. 16 is a cross-sectional view of the cartridge bottom portion taken along line 16-16 of FIG. 13.
Figure 16A:
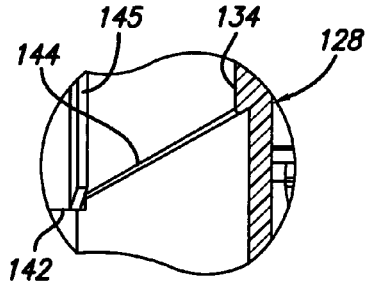
FIG. 16A is a cross-sectional view of a detail of the cartridge bottom portion taken along cutaway line 16A of FIG. 16.
Figure 17:
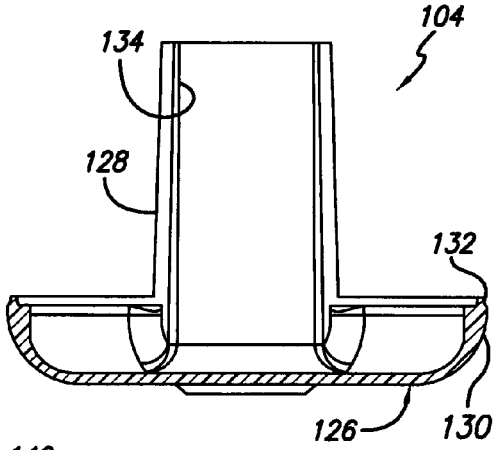
FIG. 17 a cross-sectional view of the cartridge bottom portion taken along line 17-17 of FIG. 16.
Figure 18:
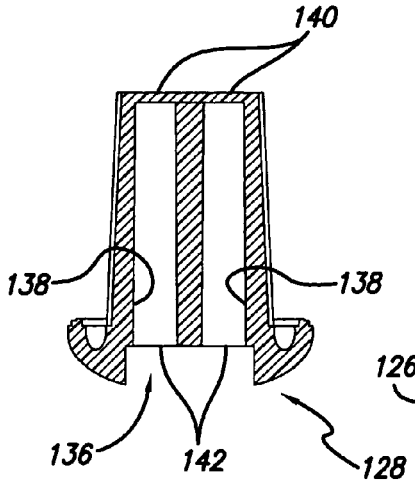
FIG. 18 is a cross-sectional view of the cartridge bottom portion taken along line 18-18 of FIG. 15.
Figure 19:
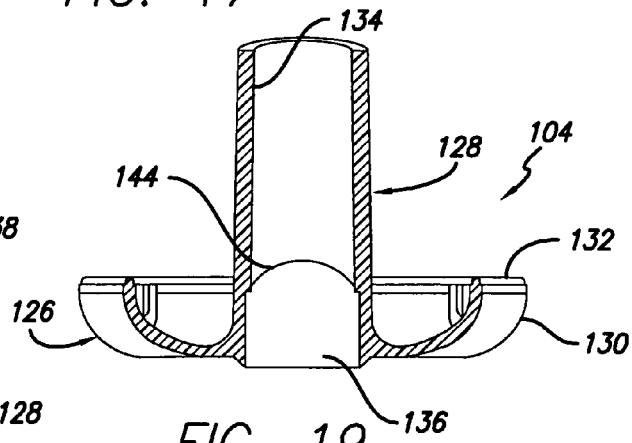
FIG. 19 is a cross-sectional view of the cartridge bottom portion taken along line 19-19 of FIG. 15.

As shown in FIGS. 8A, 16, 16A and 19, a flow director 144 in tube 134 adjacent exit port area 136 comprises an angled part which is adapted to direct fluid flow towards ends 142 of tubular chambers 138 for impacting control stick 224*a* or pellets 224*b*. Such directed fluid flow is also implemented, as depicted in FIGS. 11 and 14-16A, by a pair of vertically extending ribs 145 which are formed on the walls of tube 144 and, as illustrated in FIGS. 12 and 16, by an inclination 141 on top wall 140 towards tube 134 and ribs 145.

A key 146 and a keyway 148 are provided respectively on the interior surface of tubular wall 106 (see FIGS. 2 and 9) and on the backside of upwardly extending discharge section 128 (see FIGS. 11-13 and 16). The key and keyway are disposed to provide an orientation and proper alignment between top and bottom portions 102 and 104 and, through the orienting mechanism of keys 116 with the urinal, to place exit port area 136 adjacent exterior drain 440 (e.g., see FIGS. 2 and 54).

As depicted in FIGS. 2, 8, 10 and 52-54, a baffle 150 is disposed to be secured to curved vertical separator 120 for improved direction and flow of fluids through the cartridge in a region from inlet compartment 122 to outlet compartment 124, as more fully described in co-pending patent application, Ser. No. 11/032,310 (U.S. Provisional Application No. 60/579,921, filed 14 Jun. 2004).

One embodiment (the above-referenced second embodiment) of the urine diverter is depicted in FIGS. 20-27B. Here diverter 170 is positionable atop cylinder upper wall 110, e.g., as shown in FIG. 1, for protectively covering cartridge openings 114 and 115 at center portion 112, primarily to provide a circuitous path for flow of urine to the openings. Therefore, urine is prevented from directly contacting and entering into the openings. Diverter 170 includes a shell 172 and, if desired, a deodorant and/or sanitizing tablet 210 and a tablet retainer 200 (see FIGS. 28-33) for retaining the tablet within shell 172. The diverter is slightly spaced from upper wall 110 of cartridge 100 to assure a clear path for flow of the urine and to space retainer 200 and tablet 210 from the cartridge upper wall. As shown in detail in FIGS. 24 and 24A-24C, such spacing is effected by use of standoffs 182, which depend from shell 172 and in which each comprises a large portion 182*a* and a smaller portion 182*b*. Portion 182*b* is made as small as possible to permit the smallest contact of the diverter with the cartridge and, therefore, to provide the largest possible unobstructed flow path.

Figure 20:
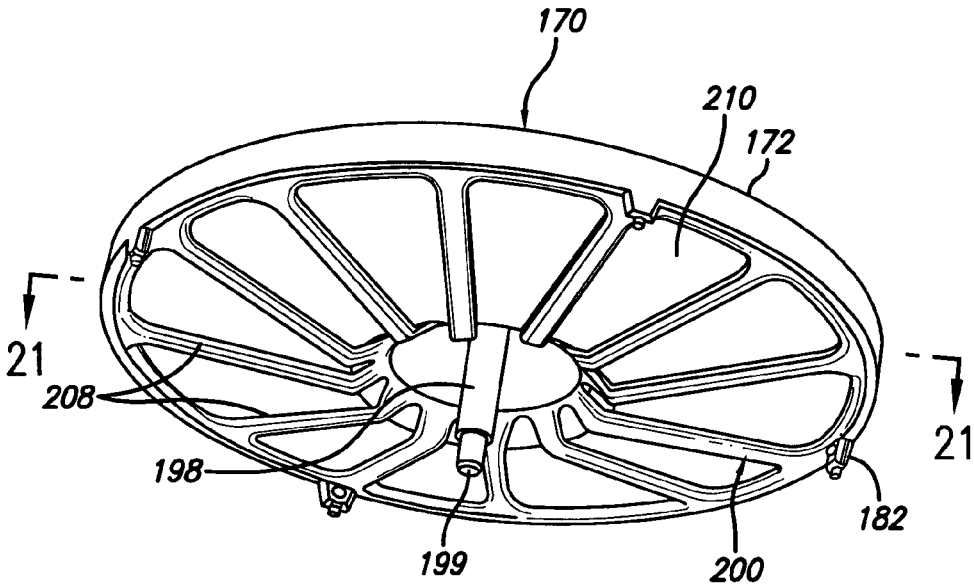
FIG. 20 is a bottom view, in perspective, of a second embodiment of the diverter as illustrated in FIG. 1, with a urine pre-treatment tablet and a retainer for the tablet latched to the diverter.
Figure 21:
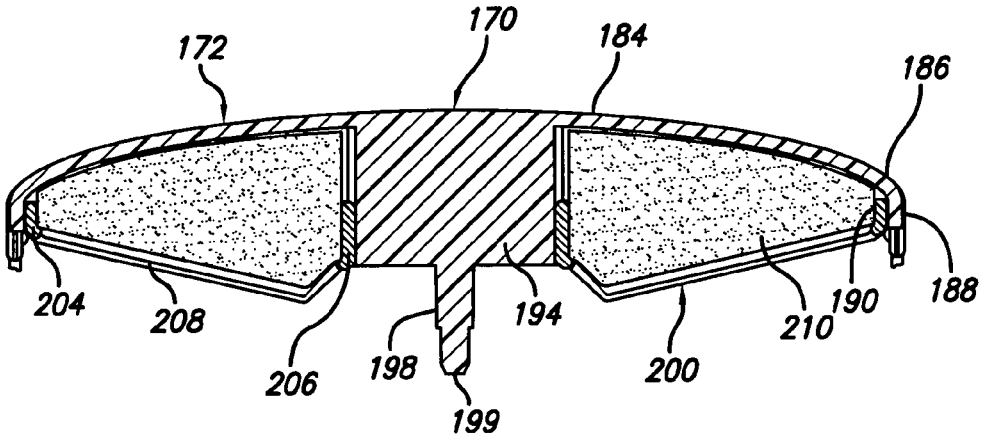
FIG. 21 is a cross-sectional view of the diverter, tablet and retainer taken along line 21-21 of FIG. 20.
Figure 22:
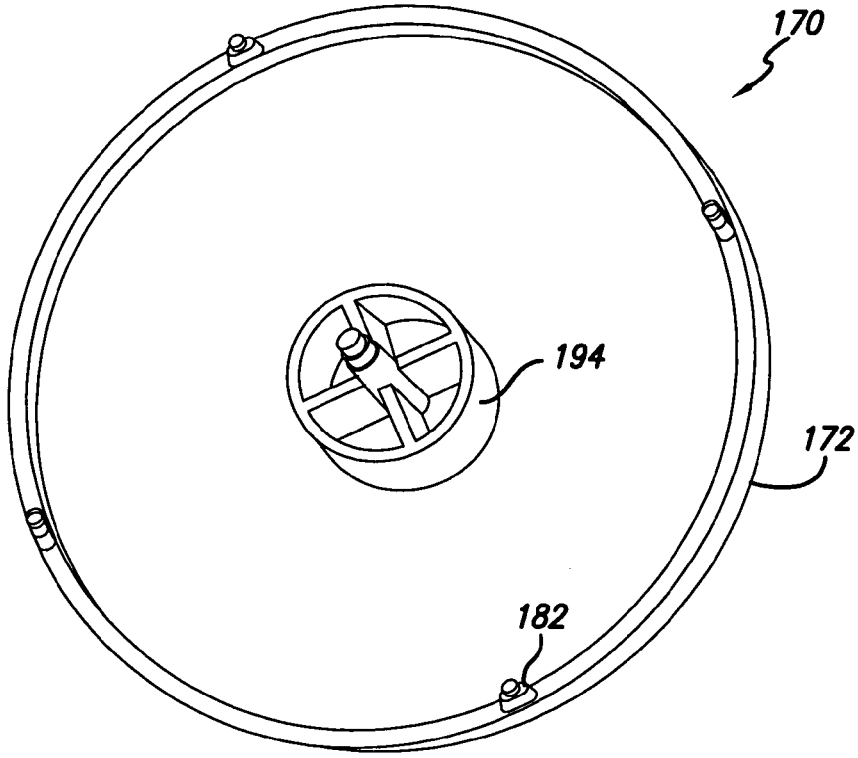
FIG. 22 is a perspective view of the underside of the diverter, per se, shown in FIG. 20.
Figure 23:
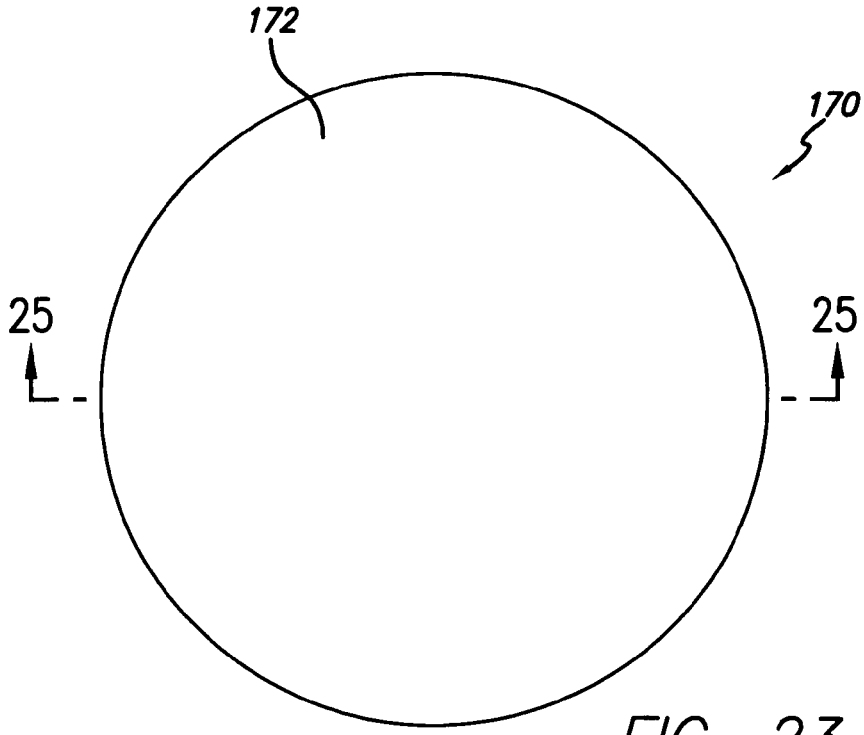
FIGS. 23 and 24 respectively are top and side views of the second embodiment of the diverter, per se, illustrated in FIG. 22.
Figure 24:
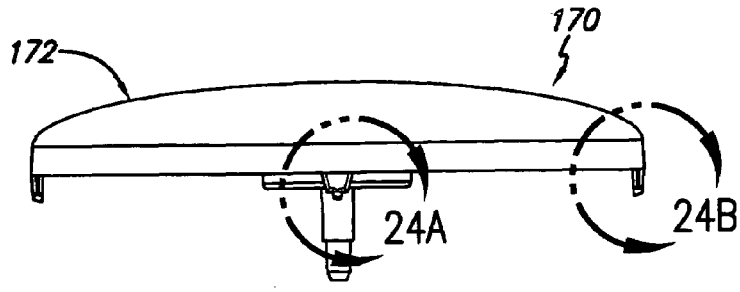
Figure 24A:
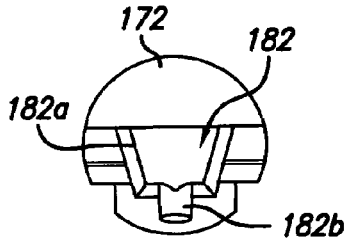
FIG. 24A is a front view of a detail of a standoff spacer of the diverter taken along cutaway line 24A of FIG. 24.
Figure 24B:
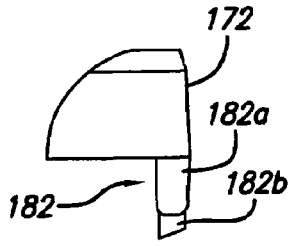
FIG. 24B is a side view of a detail of the standoff spacer of the diverter taken along cutaway line 24B of FIG. 24.
Figure 24C:
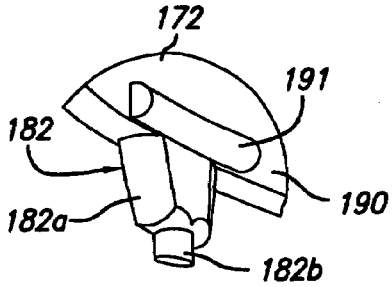
FIG. 24C is a perspective view of the standoff spacer detail and retainer latch for retaining the pre-treatment tablet of the diverter illustrated in FIGS. 24, 24A and 24B.
Figure 25:
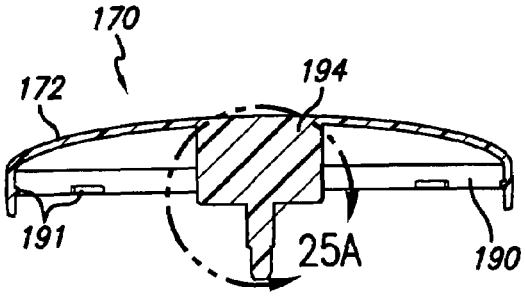
FIG. 25 is a cross-sectional view of the diverter taken along line 25-25 of FIG. 23.
Figure 25A:
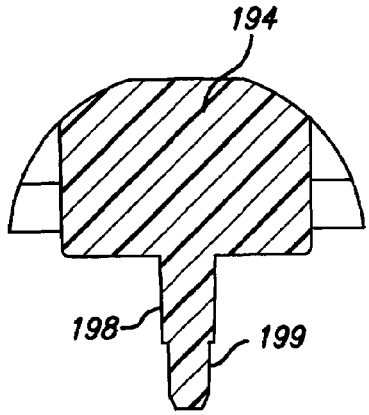
FIG. 25A is a cross-sectional view of a detail of the diverter taken along cutaway line 25A of FIG. 25.
Figure 26:
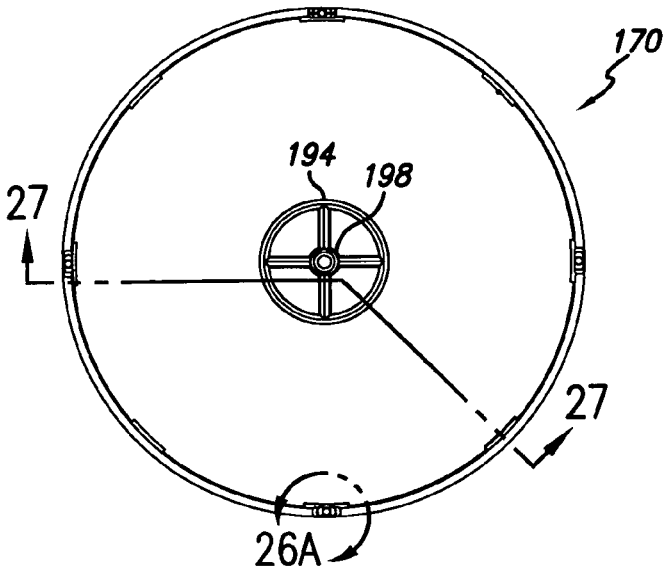
FIG. 26 is a bottom view of the diverter, per se, depicted in FIG. 22.
Figure 26A:
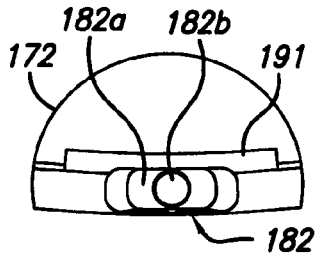
FIG. 26A is a bottom view of a detail of the standoff spacer of the diverter taken along cutaway line 26A of FIG. 26.
Figure 27:
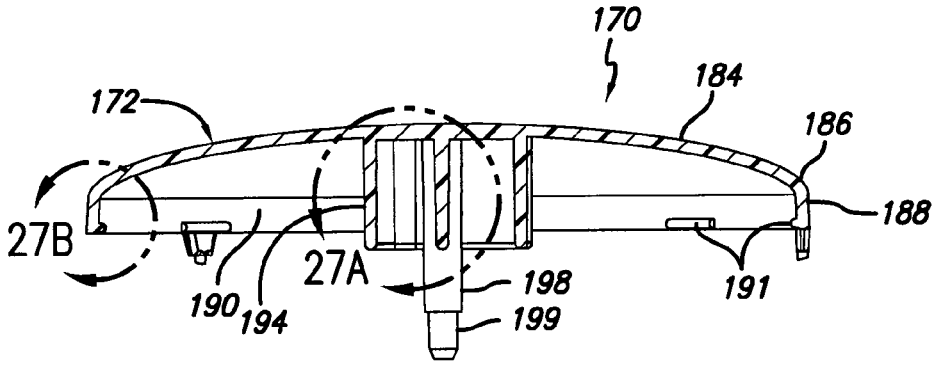
FIG. 27 is a cross-sectional view of the diverter taken along line 27-27 of FIG. 26.
Figure 27A:
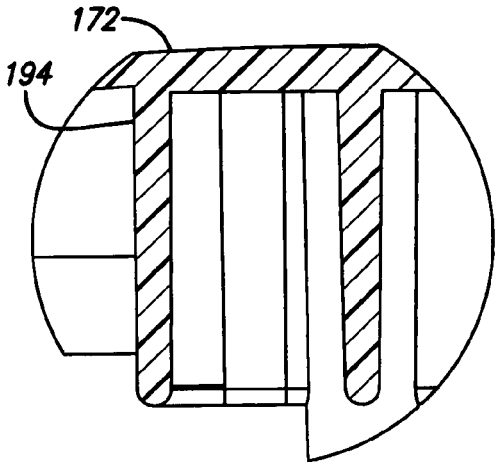
FIG. 27A is a cross-sectional view of a detail of the diverter taken along cutaway line 27A of FIG. 27.
Figure 27B:
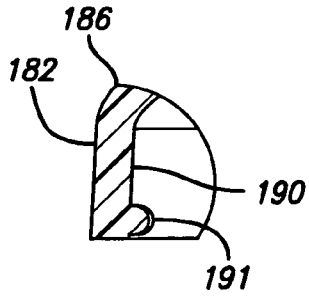
FIG. 27B is a cross-sectional view of a detail of the diverter and retainer latch taken along cutaway line 27B of FIG. 27.
Figure 28:
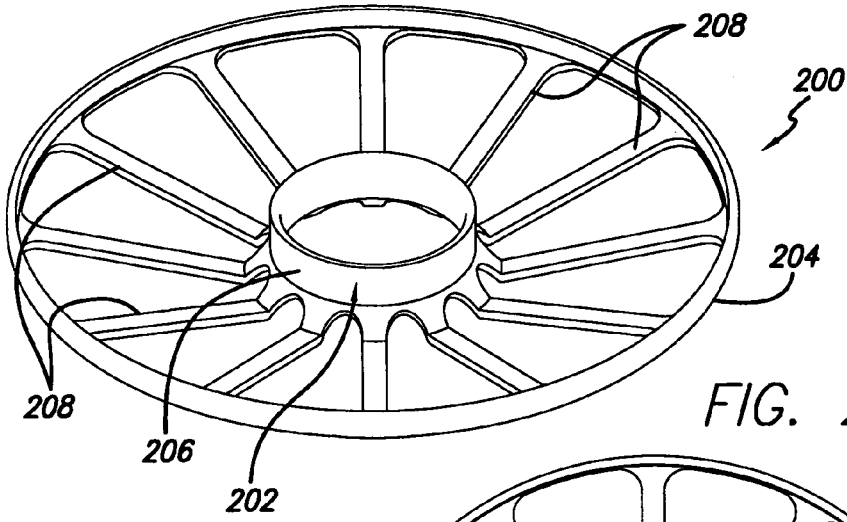
FIG. 28 is a perspective view of the retainer, per se, depicted in FIGS. 20 and 21.
Figure 29:
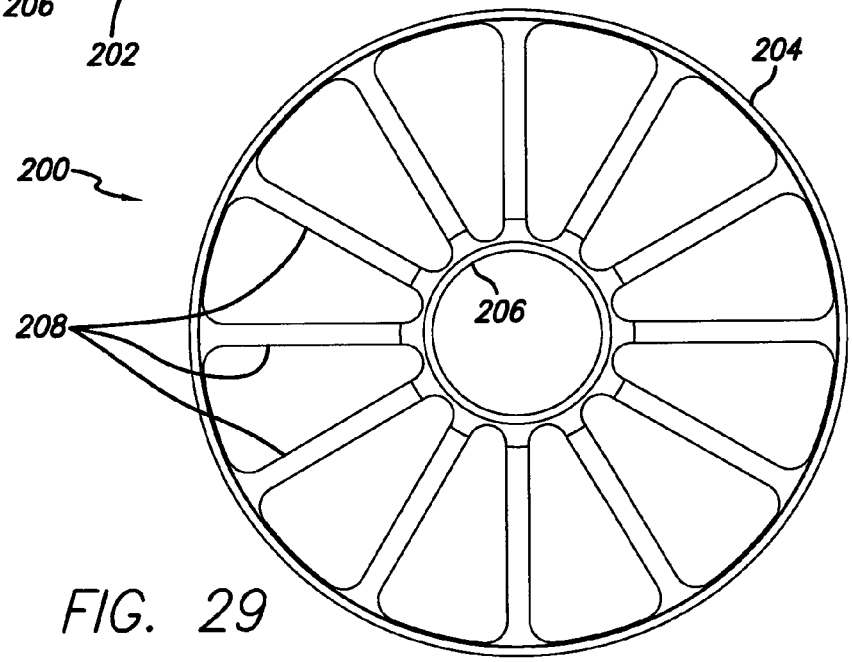
FIGS. 29 and 30 are top and side views of the retainer depicted in FIG. 28.
Figure 30:
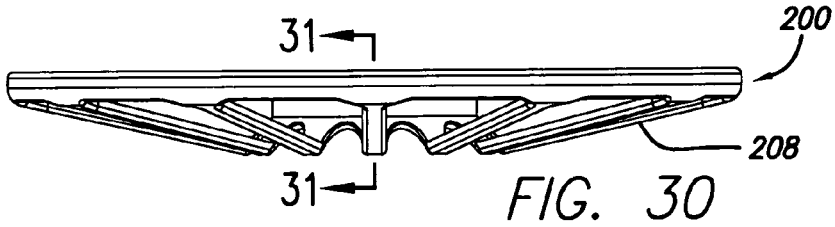
Figure 31:
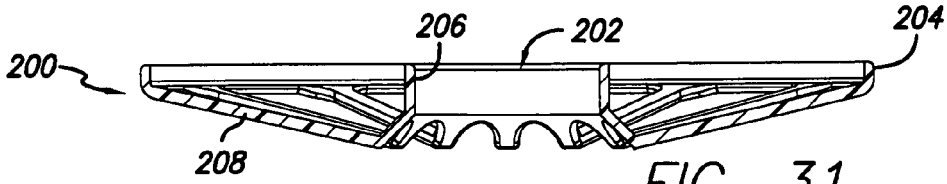
FIG. 31 is a cross-sectional view of the retainer taken along line 31-31 of FIG. 30.
Figure 32:
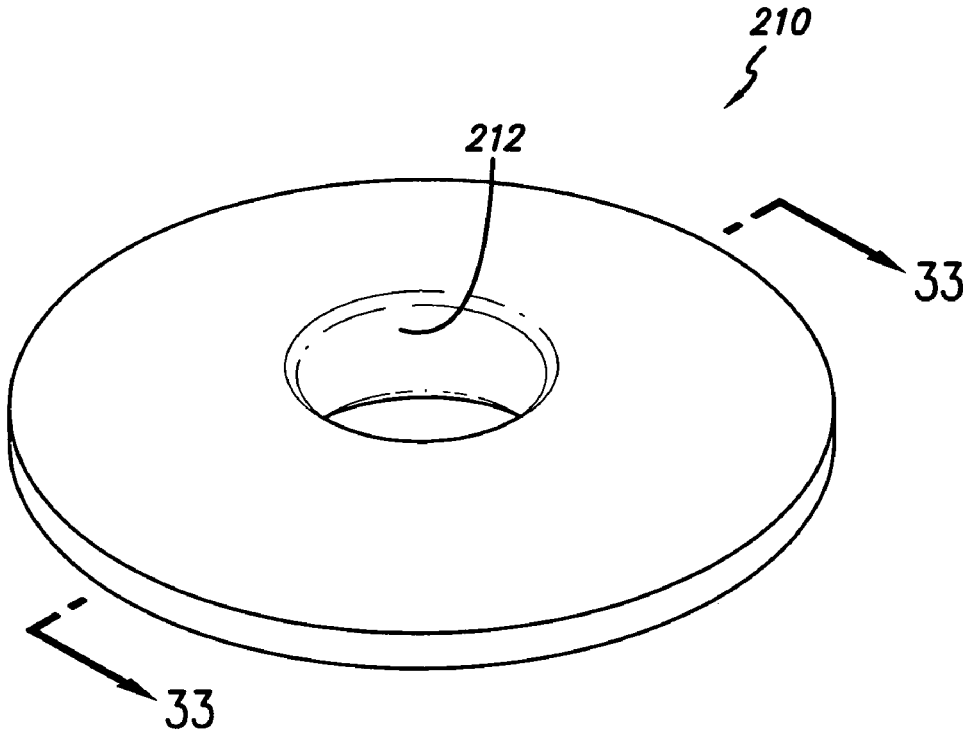
FIG. 32 is a perspective view of the urine pre-treatment tablet, per se, depicted in FIGS. 1, 20 and 21.
Figure 33:
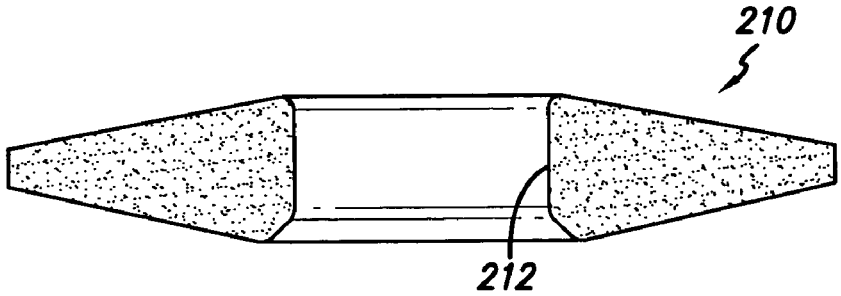
FIG. 33 is a cross-sectional view of the pre-treatment tablet taken along line 33-33 of FIG. 32.
Figure 34:
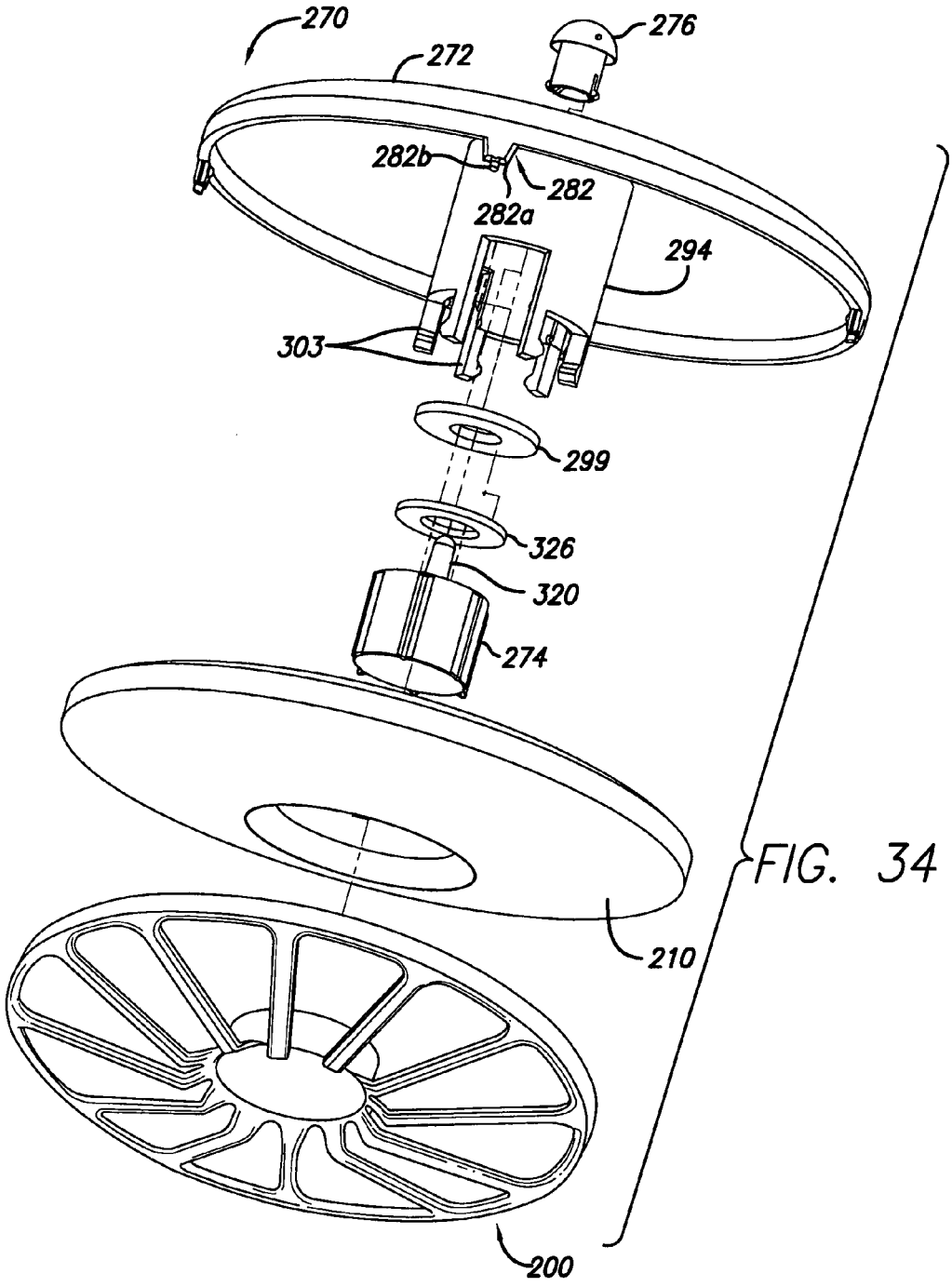
FIG. 34 is a perspective view of the first embodiment of the diverter, pre-treatment and retainer depicted in FIG. 1.

Shell 172, as for example shown in FIGS. 21 and 27, comprises an upper surface 184, terminated by a periphery 186 having a downwardly depending flange 188, which defines a central opening 190. Upper surface 184 slopes downwardly towards periphery 186 to encourage flow of urine towards the periphery. Inwardly-facing bumps or protuberances 191 are formed adjacent to and between large portions 182*a* of standoffs 182, as best shown in FIGS. 24C, 25, 26, 27 and 27B. The protuberances may be circular (FIG. 20) or elongated (FIGS. 24C, 26, 26A, 27 and 27B).

A tubular housing 194 (see FIGS. 21, 22, 25, 25A, 26, 27 and 27A) preferably of cylindrical configuration is secured at one end to the under surface of shell 172 and terminates in a securing mechanism 198 at its free end. A smaller diameter, slightly conical end 199 is formed at the free end, and is sized to form an interference fit within opening 115 (FIG. 6) in top cartridge upper wall 110.

With reference to FIGS. 28-31, tablet retainer 200 comprises an open-structured cup 202 for supporting a tablet 210 (see FIGS. 32 and 33) and for exposing the tablet to any urine collected on top wall 110 of top portion 102. The open-structured cup comprises an outer ring-like member 204, an inner ring-like member 206, and a plurality of spokes 208 connecting inner and outer ring-like members 206 and 204. The dimension of the periphery of outer ring-like member 206 and that of the inner surface on flange 188 of shell 172 are correlated to enable outer ring-like member 206 to fit within flange 188 and to latch over bumps or protuberances 191 so as to latch retainer 200 to shell 172 and, thereupon, to hold tablet 210 in position as shown in FIGS. 20 and 21 and to be spaced slightly above cartridge top wall 110. In addition, tablet 210 is configured generally as a donut having an inner cylindrical opening 212 which is adapted to fit over the outer periphery of inner ring-like member 206.

The contents of tablet 210 include a formulation of citric acid, quaternary ammonium and triclosan, and a binder to hold the formulation together. The citric acid is used (1) to adjust the ph in the cartridge, between 5.5 and 3.0 ph to ensure that the contents remain acidic, and to prevent alkalinity which would otherwise degrade the sealant, (2) to inhibit biological growth and/or (3) to act as a cleaning agent, e.g., to remove scale and other minerals, stains, etc., within the cartridge and drain pipe. The binder, a polymer binding medium which holds and permits release of the agents held therein. It is believed that the quaternary ammonium comprises a surfactant having a negative ion which is adapted to combine with a positive ion surfactant and to form precipitants. The problem to be avoided is to inhibit the breakdown of the sealant by positive ion surfactants, such cleaning agents used in urinals. While a negative ion surfactant, such as Hyamine 1622, trademark of Rohm and Haas, has been found to be useful, the requirement is one that militates against the breakdown of the sealant. Triclosan is a biocide, a potent wide spectrum antibacterial and antifungal agent, which is designed to combine with polymers and to protect the sealant from bacteria. The binder is formulated from a slightly soluble material, e.g., N, N-ethylenebisstearamide, which can be slowly worn away by water such as to the extent that its life will last at least to the life of the cartridge.

Figure 39:
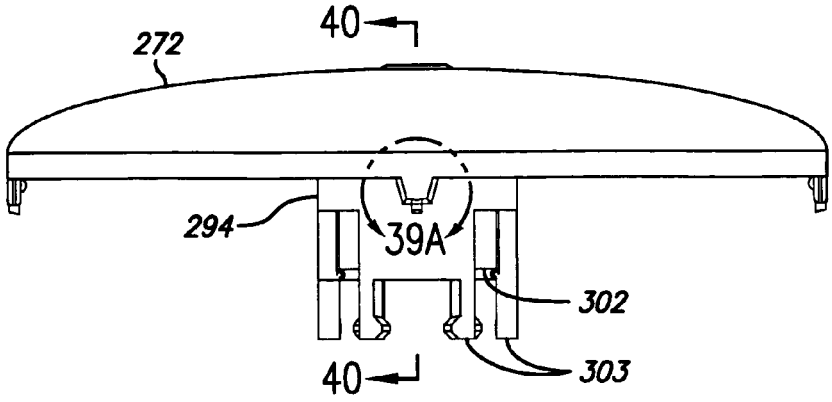
FIG. 39 is a side view of the first embodiment of the diverter, per se, depicted in FIGS. 1 and 34.
Figure 39A:
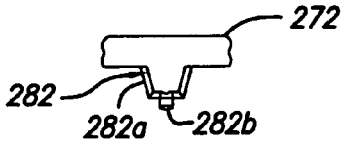
FIG. 39A is a cross-sectional view of a detail of the diverter taken along cutaway line 39A of FIG. 39.

Another embodiment of the urine diverter is depicted in FIGS. 34-46. Here diverter 270 is positionable atop cylinder upper wall 110 in place of diverter 170, as shown in FIG. 1, for protectively covering cartridge openings 114 and 115 at center portion 112, primarily to provide a circuitous path for flow of urine to the opening. Therefore, urine is prevented from directly contacting and entering into the openings. Diverter 270 includes a shell 272, a urine level detector, comprising a float 274 and a see-through protective cap 276 and, if desired, a deodorant and/or sanitizing tablet 210 and a tablet retainer 200 (see FIGS. 28-33) for retaining the tablet within shell 272. The diverter is slightly spaced from upper wall 110 of cartridge 100 to assure a clear path for flow of the urine and to space retainer 200 and tablet 210 from the cartridge upper wall. As shown in detail in FIGS. 39, 39A and 40, such spacing is effected by use of standoffs 282, depending from shell 272 and each comprising a large portion 282*a* and a smaller portion 282*b*. Portion 282*b* is made as small as possible to permit the smallest contact of the diverter with the cartridge and, therefore, to provide the largest possible unobstructed fluid flow path.

Figure 40:
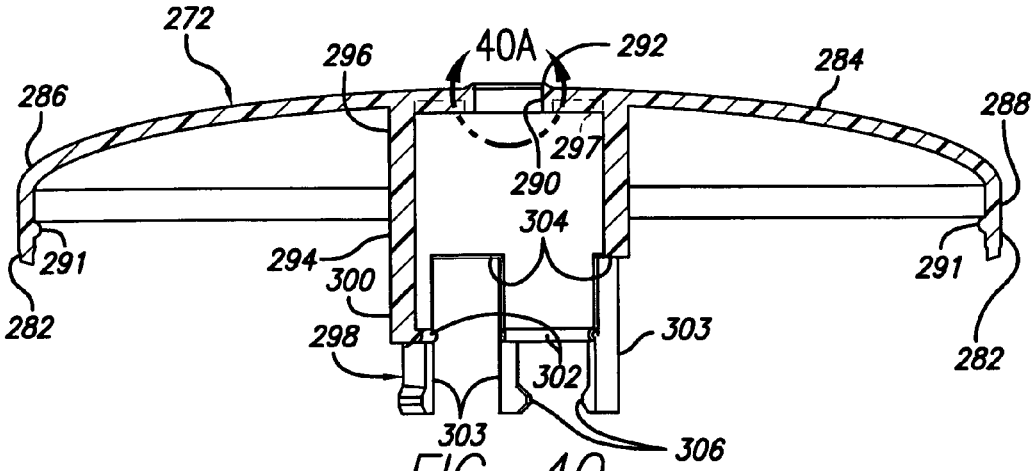
FIG. 40 is a cross-sectional view of the diverter, per se, taken along line 40-40 of FIG. 39.
Figure 40A:
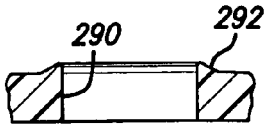
FIG. 40A is a cross-sectional view of a detail of the diverter taken along cutaway line 40A of FIG. 40.

Shell 272, as for example shown in FIGS. 40 and 40A, comprises an upper surface 284, terminated by a periphery 286 with a downwardly depending flange 288, and a central opening 290. Upper surface 284 slopes downwardly towards periphery 286 to encourage flow of urine towards the periphery and away from opening 290. Further, a rim 292 (FIG. 40A) surrounds opening 290 also to encourage the outward urine flow and, in particular, also to prevent urine from entering opening 290. Inwardly-facing bumps 291 are formed on large portion 282*a* of standoffs 282.

A tubular housing 294 (see FIGS. 34 and 36-40) preferably of cylindrical configuration, is secured at one end 296 (FIG. 40) to the under surface of shell 272 about opening 290 and terminates in a latching mechanism 298 at its second end 300. An inwardly directed circular protuberance 302 is formed at end 300. The second end is also formed with cut-away portions 304 which dissect protuberance 302 into legs 303 to permit a bending of the latching mechanism. Latching mechanism 298 comprises pairs of facing teeth 306 at the ends of legs 303 which are adapted to latch into arced slots 114*a*, 114*b* and 114*c* of cartridge top portion 102, for securing diverter 270 to cartridge 100.

Also formed in the under surface of shell 272 about opening 290 and within the interior of tubular housing 294 is a recess 297 (FIG. 40) in which a ring 299 of ferromagnetic material (see FIG. 34) is molded.

Figure 41:
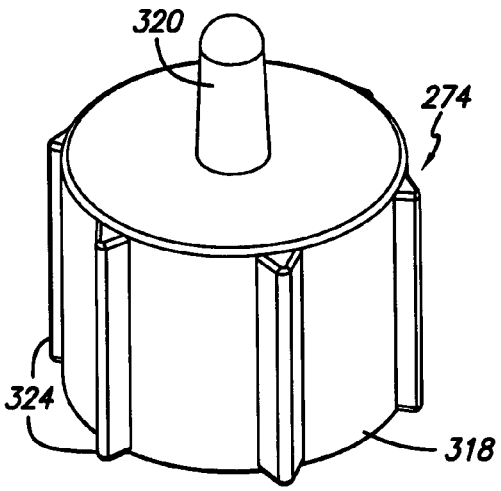
FIG. 41 is a perspective view of a float used in the diverter depicted in FIGS. 1 and 34.
Figure 42:
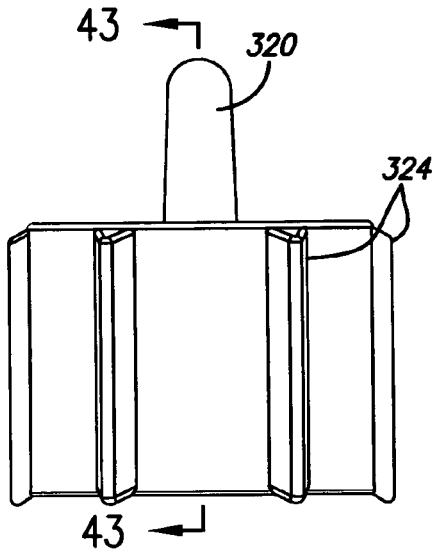
FIG. 42 is a side view of the float illustrated in FIG. 41.
Figure 43:
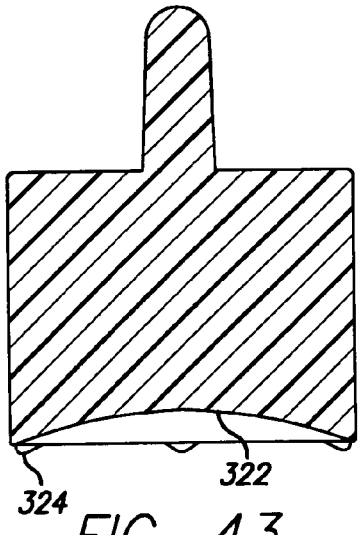
FIG. 43 is a cross-sectional view of the float taken along line 43-43 of FIG. 42.

With reference now to FIGS. 41-43, float 274 comprises a generally tubular body 318 from which a stem 320 extends from its upper surface. Its lower surface 322 is concavely formed so that any liquids thereon will flow off the concave surface and not collect thereon or leave deposits after the liquid has evaporated. A plurality of ribs 324 are placed about body 318, and extend slightly below concave surface 322 so as to help any liquid to collect and form drops for facilitating the removal of liquid from the float. Ribs 324 are configured with a generally triangular cross-section to form outer peripheries having a small surface which, in aggregation, delineate a cylindrical surface that fits closely within the inner surface of shell-depending tubular cylindrical housing 294. Accordingly, ribs 324 permit the float to move between the under surface of shell 272 and cartridge upper wall 110. The float is retained within tubular cylindrical housing 294 on protuberances 302 therein (see FIG. 38). Insertion of the float within the housing is permitted by flexure of its lower or second end 300 through the medium of cut-away portions 304. Float 274 preferably is molded from a material that can be tinted so as to make it easily viewable, such as by a bright red and/or florescent shade, especially from the top of stem 320. When tablet retainer 200 is used, a passage within inner ring-like member 206 enables contact of the float with any urine collected in the upper wall of cartridge 100.

A magnet 326 (FIG. 34), having the shape of a torus, is secured to float 274 about its stem 320 and, upon upward movement of the float, latches to ferromagnetic washer 299 which, as secured to shell 272 within recess 297, holds the float against shell 272.

Figure 44:
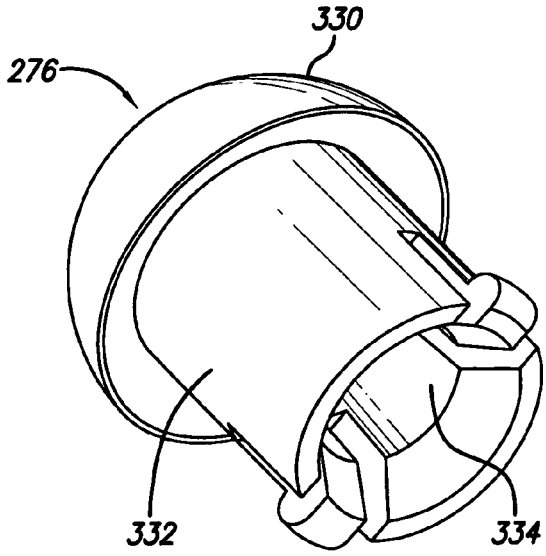
FIG. 44 is a perspective view of a see-through protective cap used in the diverter depicted in FIGS. 1 and 34.
Figure 45:
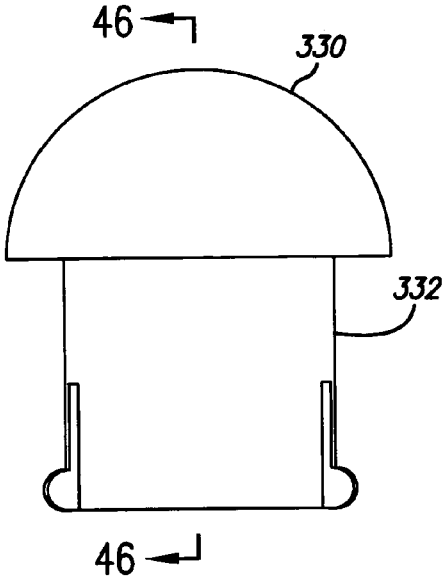
FIG. 45 is a side view of the protective cap shown in FIG. 44.
Figure 46:
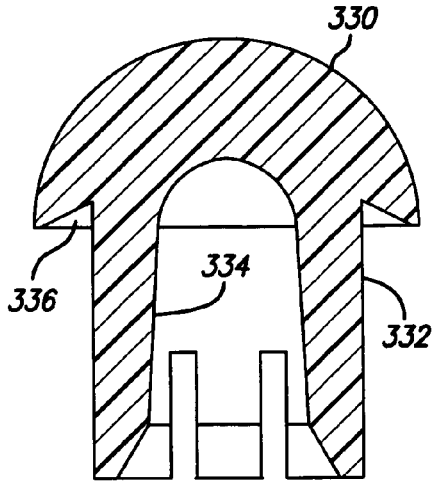
FIG. 46 is a cross-sectional view of the protective cap taken along line 46-46 of FIG. 45.
Figure 47:
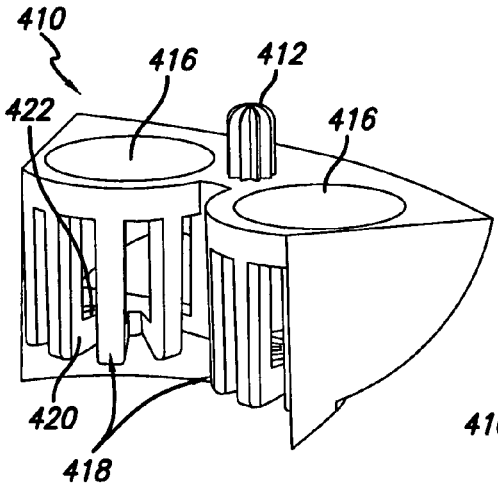
FIGS. 47 and 48 are perspective views of a plug, respectively taken towards its top and bottom surfaces, which plug is placeable in the bottom portion of any of the cartridges, e.g., as depicted in FIGS. 1-5, 7-10 and 52-54.
Figure 48:
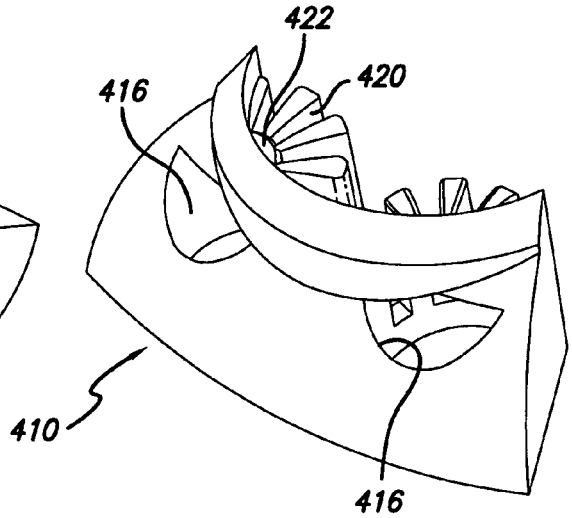
Figure 49:
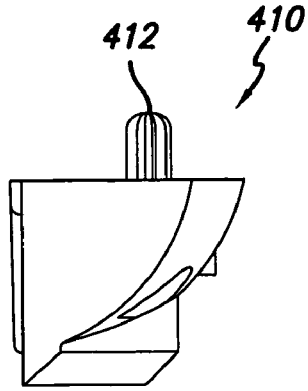
FIGS. 49-51 respectively are side, bottom and top views of the plug shown in FIGS. 47 and 48.
Figure 50:
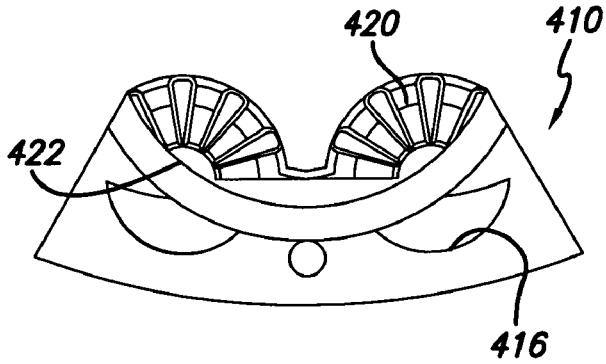
Figure 51:
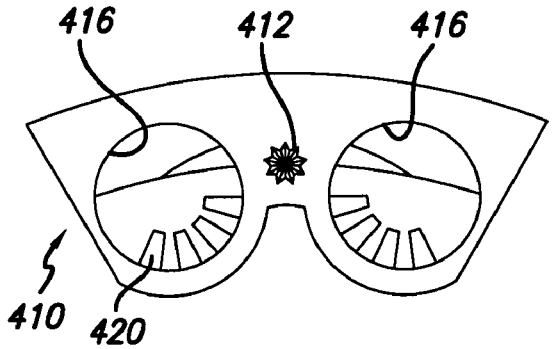

Protective cap 276, as illustrated in FIGS. 44-46, is configured to resemble a mushroom and comprises an enlarged head 330 and a relatively smaller stem 332 extending therefrom. Stem 332 is recessed to form a hollow 334, and is sized to extend through shell upper surface opening 290 and thereby to receive float stem 320. An indentation 336 (FIG. 46) is formed beneath enlarged head 330 adjacent hollow stem 332 and helps to discourage flow of urine onto the hollow stem. Indentation 336 thus acts as an adjunct to rim 292 formed about shell opening 290 to help in directing the flow of urine. Protective cap 276 is formed from a clear or translucent material, such as of acrylic plastic, to enable viewing of float 274 and, in particular, the top of its stem 320.

As shown in FIGS. 47-51, a plug 410 is disposed to be attached to bottom portion 104 (see also FIGS. 2-5, 7-9, 12 and 52-54, for example) within a part of exit port area 136. Plug 410 operates as a closure to open ends 142 (e.g., FIGS. 12 and 16) of tubular chambers 138. A pin 412 extends from the top side of plug 410 and is disposed to engage in a keyed interference fit within an opening 414 (see FIGS. 8A and 16) in bottom portion 104 to join the two parts together. Both pin 412 and opening 414 have mating ribs that, when inter-engaged, orient plug 410 with respect to tubular chambers 138. The plug is formed with a pair of tubular openings 416 having the same dimensions as those of tubular chambers 138 of bottom portion discharge tube section 128. One side of tubular openings 416 is formed to provide an open basket-like weave 418 with openings 420, and a base 422 which is adapted to support a holder of post-treatment discharge control chemical agents, configured as sticks 224*a* or pellets 224*b*. It is through openings 420 that fluid is directed by the two-part flow director comprising angled ledge 144 and ribs 145 within tube 134.

Figure 52:
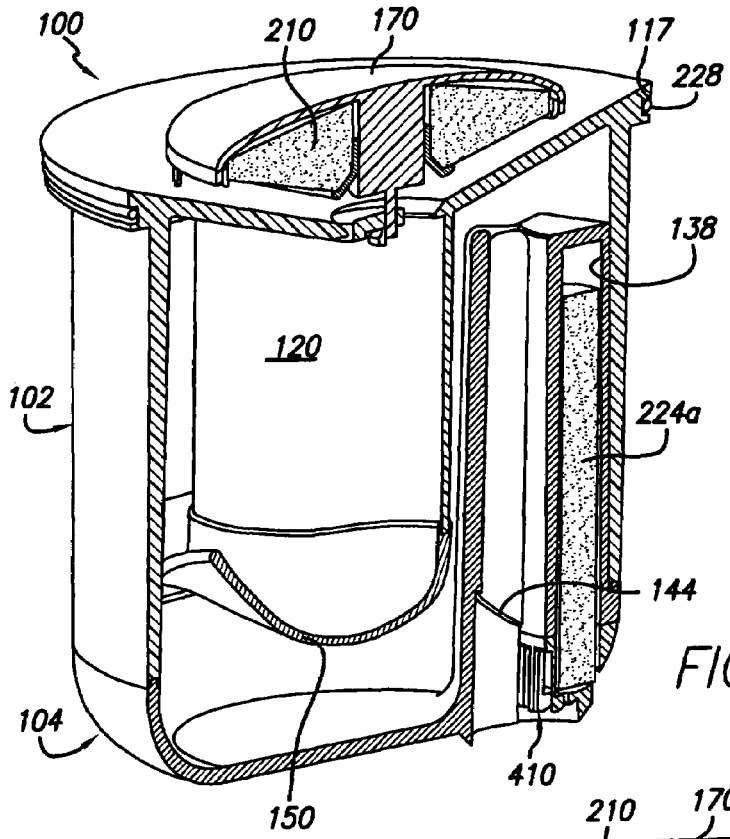
FIGS. 52 and 53 are perspective views of cartridges, similar to the cartridge illustrated in FIG. 1, with alternatively packaged post-treatment chemicals, embodied respectively as sticks and spheroids, used to treat urine as it exits the cartridge.

A pair of such post-treatment discharge control sticks 224*a* or pellets 224*b*, of which one each is illustrated in FIGS. 52 and 53 and identified generally in FIG. 54 by indicium 224*a*, are disposed to be placed within tubular chambers 138. Each one of pellets 224*b*, as having a spherical shape, rests against the inner wall of tubular chambers 138 with a smaller contact than does the contact between stick 224*a* with the inner wall and, therefore, is the preferable shape, as being more likely to move downwardly as fluid slowly erodes the post-treatment discharge chemicals. Each post-treatment discharge control stick or pellet includes citric acid and, if desired, quaternary ammonium, a biocide and cleaning agents held in a time-release binder. Its use is primarily as a descaling agent to help maintain a clean drain pipe, and especially in environments where the cartridge use pattern is such that additional descaling is needed. The post-treatment discharge control sticks or pellets may be used alone or in conjunction with pretreatment control tablet 210.

Figure 35:
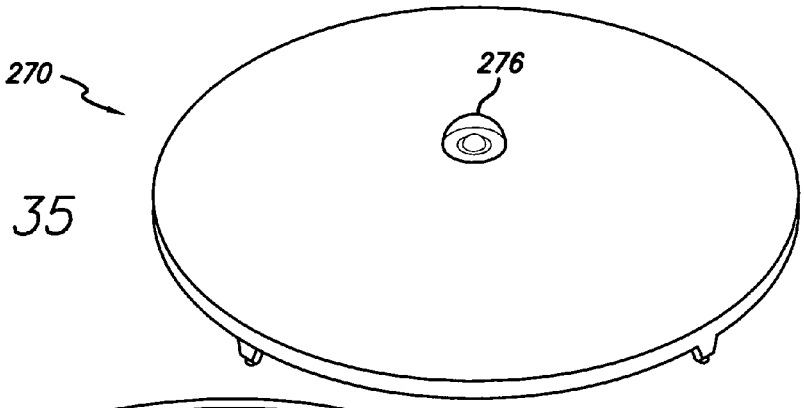
FIGS. 35 and 36 respectively are top and bottom views of the first embodiment of the diverter, pre-treatment and retainer depicted in FIG. 34.
Figure 36:
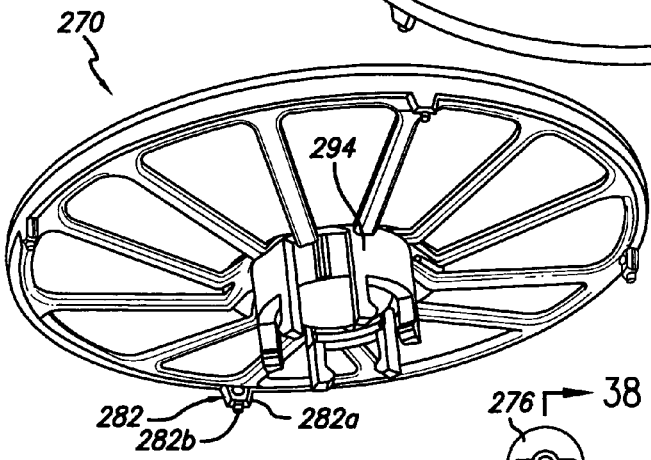
Figure 37:
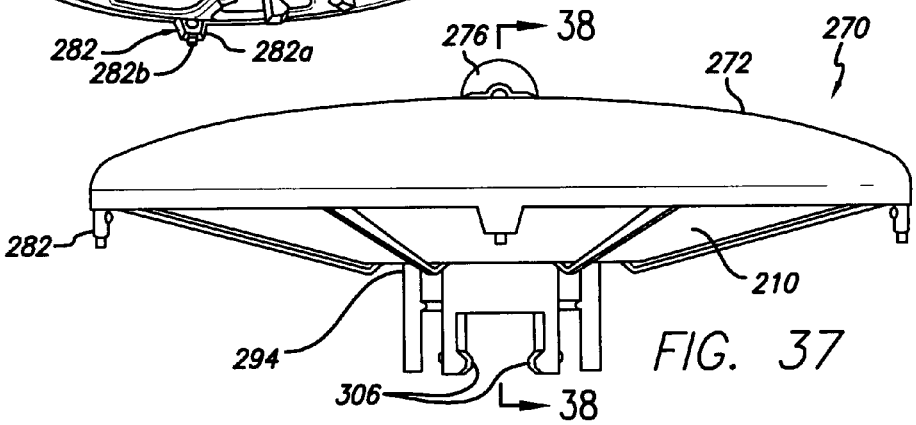
FIG. 37 is a side view of the tip side of the first embodiment of the diverter, pre-treatment and retainer depicted in FIG. 34.
Figure 38:
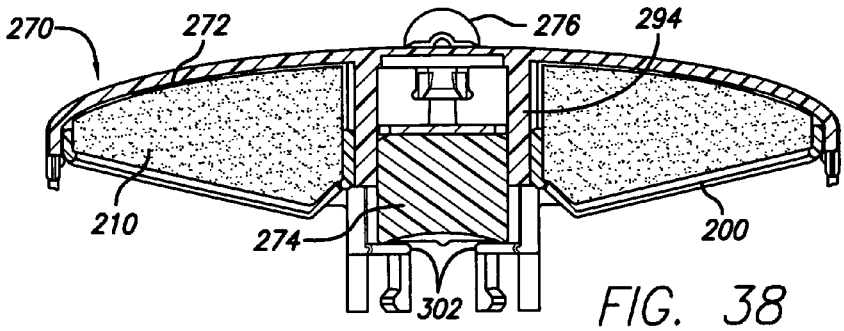
FIG. 38 is a cross-sectional view of the first embodiment of the diverter, pre-treatment and retainer taken along line 38-38 of FIG. 37.

When all the above-described components are assembled together, they form cartridge 100 as depicted, for example, in FIGS. 1 and 35. This assembled cartridge is then adapted to be placed within a water-free urinal 426, a portion of which is illustrated in FIG. 54 and which is coupled to a drain 420 with exit port area 136 as provided through the orienting mechanism of keys 116. An O-ring seal 228 is placed within recess 117 in the periphery of top wall 110.

While pretreatment control tablet 410 and post-treatment discharge control agents 224*a* or 224*b* are described herein as integral parts of the present invention, it is to be understood that they can be used alone, in other environments. In a like manner, cartridge 100 of the present invention may employ other means, aside from tablet 210 and agents 224, to obtain the desired anti-bacterial, cleaning, etc., purposes. Furthermore, both the tablet and stick/pellet agent can be composed of any number of other agents and ingredients depending upon the end result desired. Also, the diverter may be used alone, without any pretreatment tablet.

Although the invention has been described with respect to particular embodiments thereof, it should be realized that various changes and modifications may be made therein without departing from the spirit and scope of the invention.

What is claimed is:

1. In a urine cartridge having an upper wall and an opening therein for receipt of urine and for entry of the urine into the cartridge, a diverter for avoiding direct access of the urine to the opening, comprising:

a shell placeable on the upper wall of the cartridge and over the opening therein;

a spacer spacing said shell from the upper wall to permit urine to flow into the upper wall opening of the cartridge;

said shell including an essentially fluid-obstructing upper surface bounded by a periphery which is spaced from the upper wall of the cartridge by said spacer, whereby said essentially fluid-obstructing upper surface is configured to direct the urine towards said periphery and thence onto the cartridge upper wall for entry into the upper wall opening; and a float moveable towards and away from the cartridge upper wall and floatable upon any urine collected on the cartridge upper wall, and an indicator associated with said float and disposed to evidence the existence of any such upper wall collected urine.

2. A diverter according to claim 1 in which a viewer is associated with said essentially fluid-obstructing upper surface to act with said float as said indicator.

3. A diverter according to claim 1 in which one of said float and said shell have a magnet secured thereto and the other of said flat and said shell incorporate a ferromagnetic part therein whereby, when said float is moved towards said shell, said float and said shell are magnetically latched together thereby to evidence the existence of any such upper wall collected urine.

4. In a urine cartridge having an upper wall and an opening therein for receipt of urine and for entry of the urine into the cartridge, a diverter for avoiding direct access of the urine to the opening, comprising:

a shell placeable on the upper wall of the cartridge and over the opening therein;

a spacer spacing said shell from the upper wall to permit urine to flow into the upper wall opening of the cartridge;

said shell including an essentially fluid-obstructing upper surface bounded by a periphery which is spaced from the upper wall of the cartridge by said spacer, whereby said essentially fluid-obstructing upper surface is configured to direct the urine towards said periphery and thence onto the cartridge upper wall for entry into the upper wall opening, and said essentially fluid-obstructing upper surface of said shell includes an opening therein;

a protective cap in said fluid-obstructing upper surface of said shell and closing the opening therein from fluid flow therein, said protective cap including a viewing window; and a float moveable towards and away from the cartridge upper wall and floatable upon any urine collected on the cartridge upper wall, said float having a viewable surface which is viewable through said protective cap viewing window when said float is caused to float upon urine collected on the cartridge upper wall and move upwards to said viewing window of said protective cap and thereby to evidence the existence of such upper wall collected urine.

5. A diverter according to claim 4 further including:

a tablet disposed as an agent which is capable of providing any such function as a deodorant and a sanitizing agent; and a retainer engageable with said shell for supporting said tablet.

6. A diverter according to claim 5 in which said retainer comprises an open-structured cup for supporting said tablet and for exposing said tablet to any urine collected in the upper wall.

7. A diverter according to claim 6 in which said open-structured cup comprises an outer ring-like member, an inner ring-like member, and a plurality of spokes connecting said inner and outer ring-like members, said inner ring-like member having a passage therein for enabling contact of said float with any urine collected in the upper wall.

8. A diverter according to claim 7 in which said shell at its periphery includes latches for engagement with said outer ring-like member and for securing said open-structured cup to said shell.

9. A diverter according to claim 4 further comprising:

a tubular housing having an end secured to said shell upper surface and extending therefrom, and being positioned coaxially with the shell upper surface opening for housing said float; and a spacing mechanism positioned between said float and said tubular housing for centering and guiding said float within said housing.

10. A diverter according to claim 9 in which said spacing mechanism comprises a plurality of ribs spaced from one another and forming a minimum contact between said float and said housing.

11. A diverter according to claim 9 further including a support on the inside of said tubular housing for supporting said float and for limiting travel thereof towards the shell upper surface.

12. A diverter according to claim 9 in which said tubular housing includes a second end spaced from said end which secures said tubular housing to said shell upper surface, and a latching mechanism at said second end engageable with the cartridge upper wall opening for securing said diverter to the cartridge.

13. A diverter according to claim 4 further comprising:

a tubular housing secured to and extending from said shell upper surface and positioned coaxially with the shell upper surface opening for housing said float; and a plurality of ribs formed on said float and dimensioned to provide a minimal frictional and guiding contact with said housing for centering said float within said housing and for providing a plurality of fluid passages therebetween.

14. A diverter according to claim 13 in which said float includes a concave-shaped bottom surface facing the urine cartridge upper wall, and said ribs extend beyond said concave-shaped bottom surface to form lips and thereby to encourage flow of any urine from said float and to discourage residual urine deposits thereon.

15. A diverter according to claim 14 further comprising a ridge surrounding the shell upper surface opening for encouraging flow of urine towards said shell periphery.

16. A diverter according to claim 15 in which said protective cap has a mushroom-shaped configuration comprising:

an enlarged head;

a relatively smaller hollow stem extending from said enlarged head through the shell upper surface opening for receipt in said hollow stem of a portion of said float; and an indentation formed beneath said enlarged head adjacent said hollow stem for discouraging flow of urine onto said stem.

17. In a urine cartridge having an upper wall and an opening therein for receipt of urine and for entry of the urine into the cartridge, a diverter for avoiding direct access of the urine to the opening, comprising:

a shell placeable on the upper wall of the cartridge and over the opening therein;

a spacer spacing said shell from the upper wall to permit urine to flow into the upper wall opening of the cartridge;

a float moveable towards and away from the cartridge upper wall and floatable upon any urine collected on the cartridge upper wall;

an indicator associated with said float and disposed to evidence the existence of any such upper wall collected urine;

a tablet disposed as an agent which is capable of providing any such function as a deodorant and a sanitizing agent;

a retainer engageable with said shell for supporting said tablet in said shell, and comprising an open-structured cup for supporting said tablet and for exposing said tablet to any urine collected in the upper wall; and said open-structured cup comprising an outer ring-like member, an inner ring-like member, and a plurality of spokes connecting said inner and outer ring-like members, said inner ring-like member having a passage therein for enabling contact of said float with any urine collected in the upper wall.

18. A diverter according to claim 17 in which said shell at its periphery includes latches for engagement with said outer ring-like member and for securing said open-structured cup to said shell.

19. In a urine cartridge having an upper wall and an opening therein for receipt of urine and for entry of the urine into the cartridge, a diverter for avoiding direct access of the urine to the opening, comprising:

a shell placeable on the upper wall of the cartridge and over the opening therein;

a spacer spacing said shell from the upper wall to permit urine to flow into the upper wall opening of the cartridge;

an attachment facilitator including at least one opening medium in said cartridge upper wall; and a coupling mechanism secured to said shell and disposed to engage said upper wall opening for enabling said shell to be coupled to said upper wall and, thus, to said cartridge, said coupling mechanism latches for latching said latches into said upper wall opening facilitator.

20. A diverter according to claim 19 in which said opening medium comprises slots for mutual latching with said latches.

21. In a urine cartridge having an upper wall and an opening therein for receipt of urine and for entry of the urine into the cartridge, the improvement comprising a float moveable towards and away from the cartridge upper wall and floatable upon any urine collected on the cartridge upper wall, said float having a viewable surface which is viewable when said float is caused to float upon urine collected on the cartridge upper wall and thereby to evidence the existence of such upper wall collected urine.

22. A urine cartridge according to claim 21 further comprising a protective cap including a viewing window placed over said float for enabling viewing of said float viewable surface.

* * * * *

UNITED STATES PATENT AND TRADEMARK OFFICE

CERTIFICATE OF CORRECTION

PATENT NO. : 7,575,022 B2
APPLICATION NO. : 11/032508
DATED : August 18, 2009
INVENTOR(S) : Michael Higgins It is certified that error appears in the above-identified patent and that said Letters Patent is hereby corrected as shown below:

On the Title Page, item (73)
The name of the assignee should read Falcon Waterfree Technologies.

Signed and Sealed this
Twenty-eighth Day of October, 2014

Michelle K. Lee

Michelle K. Lee
*Deputy Director of the United States Patent and Trademark Office*